US005914559A

United States Patent [19]

Muchi et al.

[11] Patent Number: 5,914,559

[45] Date of Patent: Jun. 22, 1999

[54] RESISTANCE ELEMENT AND CATHODE RAY TUBE

[75] Inventors: Tsuneo Muchi; Kenichi Ozawa; Tsunenari Saito, all of Kanagawa, Japan

[73] Assignee: Sony Corporation, Japan

[21] Appl. No.: 08/857,835

[22] Filed: May 16, 1997

[30] Foreign Application Priority Data

May 29, 1996 [JP] Japan ..... 8-135494

[51] Int. Cl.[6] ..... H01J 29/96

[52] U.S. Cl. ..... 313/479; 313/414; 313/449; 338/260; 338/307; 338/310; 338/314; 338/309

[58] Field of Search ..... 313/479, 449, 313/414, 412, 417; 252/502, 507, 512, 513, 516, 518, 519, 520, 521, 514; 338/115, 118, 244, 260, 275, 307, 308, 310, 312, 314, 319, 320, 309

[56] References Cited

U.S. PATENT DOCUMENTS

| | | | |
|---|---|---|---|
| 4,349,767 | 9/1982 | Muramoto et al. | 313/414 X |
| 5,631,521 | 5/1997 | Hasegawa et al. | 313/412 X |
| 5,694,004 | 12/1997 | Kimiya et al. | 313/412 X |

*Primary Examiner*—Ashok Patel
*Attorney, Agent, or Firm*—Rader, Fishman & Grauer; Ronald P. Kananen

[57] ABSTRACT

A resistance element which is formed on a substrate by resistors and which divides and supplies high voltage to an electron gun of a cathode ray tube, wherein part or all of the substrate is covered by a high resistance conductive material layer as a topmost layer, and a cathode ray tube having the same.

10 Claims, 10 Drawing Sheets

RESISTANCE ELEMENT AND CATHODE RAY TUBE

BACKGROUND OF THE INVENTION

1. Field of the Invention

The present invention relates to a resistance element used for an electron gun of a cathode ray tube that supplies an anode voltage divided into a deflection voltage, an electrode voltage, etc. and a cathode ray tube having the same.

2. Description of the Related Art

For example, in a cathode ray tube (CRT) of the Trinitron system (trade mark of SONY CORPORATION), an electron beam is made to converge by supplying a voltage 4 to 8 percent lower than the anode voltage (convergence voltage) to a static deflection plate. One of the methods used for supplying this convergence voltage to a deflection plate is the use of a resistance element known as an inner breeder resistor (IBR).

In a cathode ray tube having such an IBR, as shown by the sectional view of the neck portion of the cathode ray tube in FIG. 1, a high anode voltage is supplied from the outside of the cathode ray tube 10 from an anode button 11 through the interior carbon 12 to the electron gun 20 and IBR. This high anode voltage is divided into the convergence voltage by the IBR and is then supplied to the deflection plate 26.

This IBR and electron gun are represented in FIGS. 2A and 2B. The electron gun 20 is of a unipotential type and has a first grid $G_1$, second grid $G_2$, third grid $G_3$, fourth grid $G_4$, fifth grid $G_5$, and deflection plate 26 arranged coaxially in order from the rear side of the cathode ray tube 10 to the screen side. For example, the first grid $G_1$ is supplied with 0V, the second grid $G_2$ with 300V, the third grid $G_3$ with 27 kV, the fourth grid $G_4$ with 8 kV, and the fifth grid $G_5$ with 27 kV. The deflection plate 26 is supplied with the high voltage from the fifth grid $G_5$ through an electrode A divided by the IBR and passed through the electrode C.

The IBR, as shown in FIG. 2B, is flat and is laid near the grids $G_1$ to $G_5$ stretching between the fifth grid $G_5$ and the first grid $G_1$. On the surface of the flat substrate 31 are formed resistors 32 between the electrode A and electrode C and between the electrode C and electrode B. The electrode A is connected to the fifth grid $G_5$, the electrode C is connected to the deflection plate 26, and the electrode B is connected to the outside power supply of 300 to 1000V through a stem 27.

A plan view of the IBR is given in FIG. 3A and a side view in FIG. 3B. The IBR is comprised of a plate 96 percent alumina high insulation substrate 31 on which are formed electrodes A, B, and C using a ruthenium oxide family low resistance paste. Between the electrode A and electrode C, and between the electrode C and electrode B are formed resistors 32 in a wavy manner by coating and baking ruthenium oxide family paste. The resistors 32 are protected by being covered with high voltage resistance, high insulation glass frit (called an "overcoat" in some instances) ($B_2O_3$—$SiO_2$—PbO family) 33*a* and 33*b*. Further, the glass frit 33*c* is formed on the opposite surface of the surface on which the resistors are formed. The substrate 31 is covered by baking the resistors.

An enlarged view of the area near the electrode B is shown in FIG. 4. The overcoat layers 33*a*, 33*b*, and 33*c* are coated via silk printing to form thick layers. The overcoat layers tend to suffer from pinholes PH and bubbles BB. When the insulation is defective as a result of these, the resistors 32 are damaged. To provide enough insulation, the resistors 32 have formed over them two additional layers: the first overcoat film 33*a* and the second overcoat film 33*b*. The overall thickness of the combined films is about 0.5 mm. The overcoat film 33*c* formed on the surface opposite the surface where the resistors 32 are formed is for preventing the release of gas from the substrate 31, and has a thickness of, for example, about 20 $\mu$m. Further, an overcoat film 33*d* is formed on the ends of electrode B and the electrode C.

A high voltage of about 27 kV is supplied to the electrode A of the IBR. There is a large potential difference with the electrode B where the voltage is 300 to 1000V. The surface of the high insulation overcoat film 33*b* is charged up and the voltage gradually increases toward the electrode B. Finally, there is a discharge with the electrode B or with the first grid $G_1$, second grid $G_2$, and fourth grid $G_4$ of the electron gun 20 and further with the resistors 32. The state of this discharge Is explained with reference to FIG. 14.

In the IBR shown in FIG. 5A, the resistor 32 has a higher wave density and therefore a higher resistance at the electrode B side. The IBR is arranged near the electron gun shown in FIG. 5B. The density of the waves in the resistor 32 is changed, as shown in FIG. 6, to ease the gradient of potential of the resistor at the portion of the resistor 32 with the low wave density (and therefore lower resistance), as shown by (3), and to reduce the potential difference with the third grid $G_3$ (where anode potential is applied). If the cathode ray tube is used and a current flows to the resistor 32 of the IBR, the heat generated at the high resistance part will be great. Therefore, at the part with a low resistance heat of about 80° C. will be generated, but at the part with a high resistance, the temperature has been observed to reach 150° C.

Since the overcoat films 33*a* and 33*b* covering the resistors 32 have high insulating properties, the surface of the overcoat film 33*b* is charged up to a high potential. When the electron gun starts to be used, as shown by the line (1) in FIG. 6, the potential falls substantially linearly from the electrode A to the electrode B, but when a given time elapses, as shown by the line (2), the voltage gradually rises toward the electrode B, then finally a discharge occurs with the electrode B or with the first grid $G_1$, the second grid $G_2$, and further the fourth grid $G_4$ and further the resistors 32. When the discharge occurs, the charge is released and the potential returns to the line (1), but when a given time again elapses, the charge again rises and a similar discharge occurs in a repeating pattern. Due to this discharge, insulation breakdown of the overcoat films 33*a* and 33*b* occurs and the resistors 32 are damaged, whereupon the potential of the electrode C changes, the convergence voltage changes, and the color on the screen ends up becoming wrong.

The insulation of the IBR is therefore, very important. To ensure good insulation, the overcoat film on the resistors 32 is applied twice to form a thickness of 0.4 to 0.5 mm as a whole, and the finished IBRs are strictly inspected visually. This slower manufacturing process often results in poorer productivity.

SUMMARY OF THE INVENTION

An object of the present invention is to provide an inexpensive resistance element able to supply a divided voltage stably without being charged up and a cathode ray tube having such a resistance element.

To achieve the above object, the present invention provides a resistance element that is formed on a substrate by resistors and that divides and supplies high voltage to an electron gun of a cathode ray tube, wherein part or all of said substrate to covered by a high resistance conductive material layer as a topmost layer.

Preferably, the high resistance conductive material layer is formed via an insulating film covering the resistors on the substrate.

More preferably, the resistivity of the high resistance conductive material is $10^6$ to $10^{14}$ Ω·m at 150° C.

Still more preferably, the high resistance conductive material layer is formed so connect between the electrodes of said resistors.

Still more preferably, the substrate is comprised of a high resistance conductive ceramic.

Further, to achieve the above object, the present invention provides a cathode ray tube having a resistance element that is formed on a substrate by resistors, wherein part or all of the substrate is covered by a high resistance conductive material layer as a topmost layer, and wherein the resistance element divides and supplies high voltage to an electron gun of a cathode ray tube.

Since the resistance element of the present invention has the high resistance conductive material layer formed on its topmost surface, a very small leakage current flows through this high resistance conductive material, so the potential of the resistance element stabilizes and the surface does not charge up. Further, the potential of the high resistance conductive material layer is proportional to the path of the leakage current and the potential difference with the resistance potential of the resistors present underneath the layer is reduced.

Since there is no longer any charge-up, the surface potential stabilizes and the discharge with the surroundings is reduced. Further, since the potential difference with the resistors is reduced, discharge with the resistors does not easily arise. As a result, there is no longer any damage to the overcoat films and resistors, the resistance value stabilizes over a long period, and the convergence potential stabilizes, so there is no longer any color deviation.

Further, when the resistors are covered by insulating films, discharge to the resistors due to the presence of bubbles or pinholes in the insulating films do not easily occur either, so the inspection of the appearance of the insulating films can be simplified as well, or the insulating films can be formed thinner, or sometimes even the insulating films can be omitted and the resistors can be covered with just the high resistance conductive material. This enables costs to be reduced.

BRIEF DESCRIPTION OF THE DRAWINGS

These and other objects and features of the present invention will become more apparent from the following description of the preferred embodiments given with respect to the attached drawings, in which:

FIGS. 3A and 3B are views of an example of an IBR wherein FIG. 3A is a plan view and FIG. 3B is a side view;

FIGS. 8A to 8C are views of the mode for basically forming the high resistance conductive material layer, wherein FIG. 8A is a plan view, FIG. 8B is a side view, and FIG. 8C is a bottom view;

FIGS. 9A to 9C are views of another mode for basically forming the high resistance conductive material layer, wherein FIG. 9A is a plan view, FIG. 9B is a side view, and FIG. 9C is a bottom view;

FIGS. 10A to 10C are views of still another mode for basically forming the high resistance conductive material layer, wherein FIG. 10A is a plan view, FIG. 10B is a side view, and FIG. 10C is a bottom view;

DESCRIPTION OF THE PREFERRED EMBODIMENTS

Preferred embodiments of the present invention will be described below, but the present invention is not, of course, limited to the embodiments described.

Figure 3A:
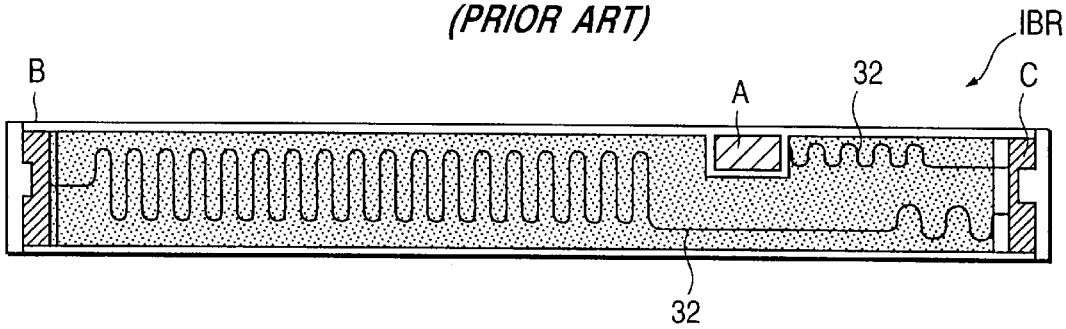
FIG. 3A (PRIOR ART)
Figure 3B:
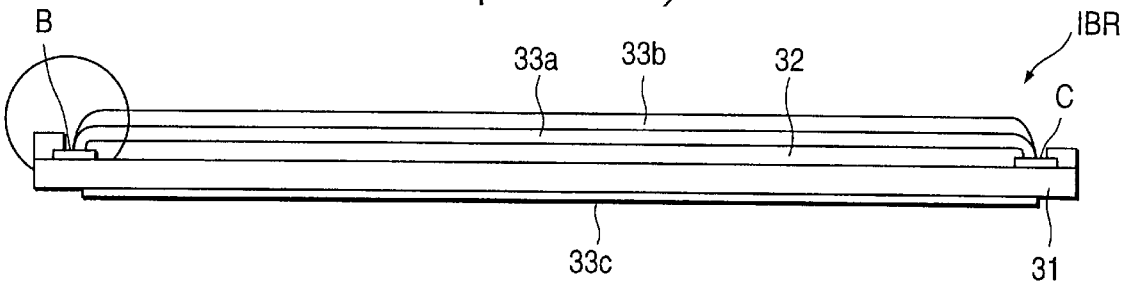
FIG. 3B (PRIOR ART)
Figure 4:
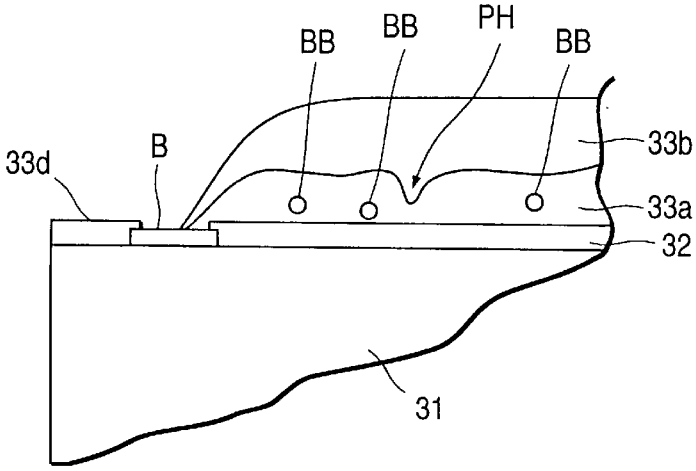
FIG. 4 (PRIOR ART)
FIG. 4 is an enlarged view of the portion surrounded by the circle in FIG. 3B.
Figure 5A:
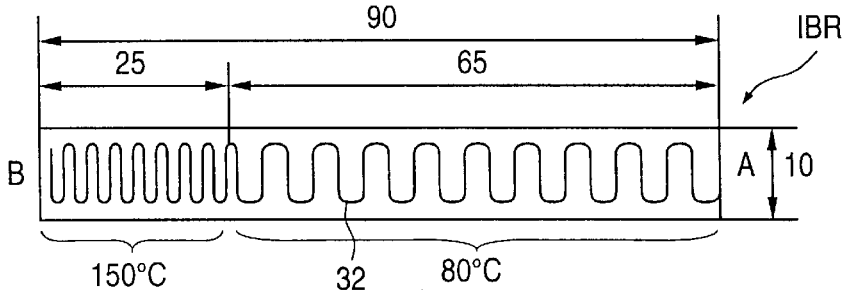
FIG. 5A (PRIOR ART)
FIG. 5A is a plan view of an IBR.
Figure 5B:
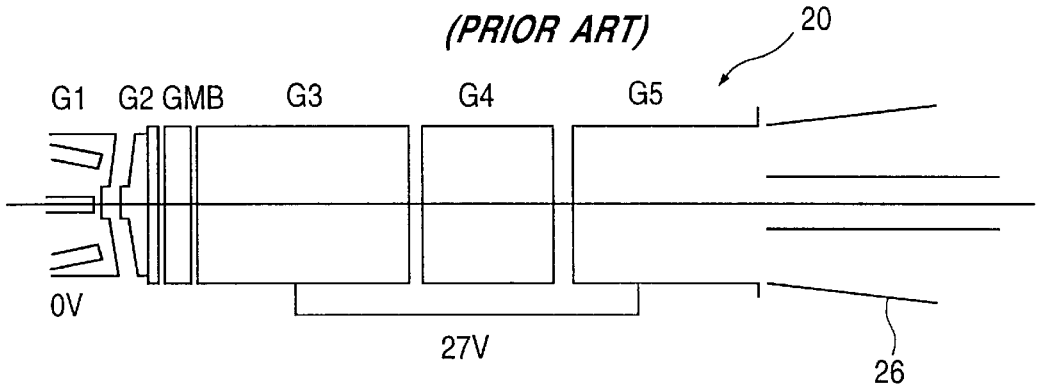
FIG. 5B (PRIOR ART)
FIG. 5B is a schematic view of the electron gun.
Figure 7:
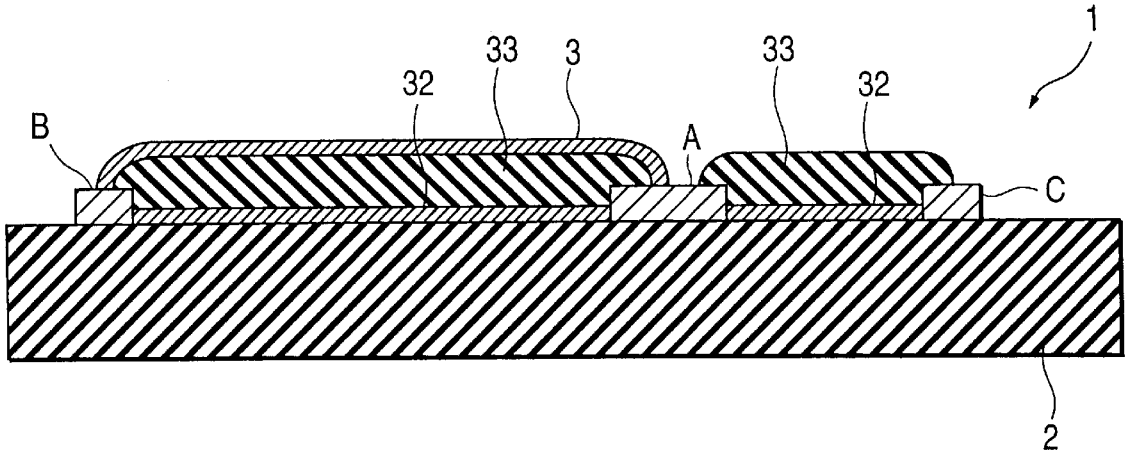
FIG. 7 is a schematic sectional view of a resistance element according to the present invention.

FIG. 7 is a sectional view of one mode of the resistance element of the present invention. Note that elements similar to elements in the related art are given the same reference numerals. The resistance element 1 is comprised, for example, of a flat 96 percent alumina insulating substrate 2 on which, for example, ruthenium oxide family low resistance electrodes A, B, and C are formed. Between these electrodes are formed, for example, ruthenium oxide family high resistance resistors 32. The surface of the substrate 2 where the resistors 32 are formed has, over substantially its entire area except for the electrodes, a high voltage resistance, high insulation glass frit (for example, $B_2O_3$—$SiO_2$—PbO family) insulating film 33 which covers the resistors 32. Further, on the part of the insulating film 33 between the electrode A and electrode B, a high resistance conductive material layer 3 covers the insulating film 33 as a topmost layer. This layer is arranged to be connected electrically with the electrode A and the electrode B. The electrodes of the resistance element 1 and the resistors 32 are no different from the related art as shown in FIG. 3A or FIG. 3B. Accordingly, the configuration of the resistors, the position of the electrodes, the configuration of the same, etc. may be in any desired arrangement.

The resistivity of the high resistance conductive material is, for example, $10^6$ to $10^{14}$ Ω·m at 150° C. If the resistance is any higher, it sometimes becomes difficult for a very small leakage current to flow, while if the resistance is any lower, the leakage current becomes too large and the power consumption of the cathode ray tube becomes too large in some cases. This high resistance conductive material is, for example, composed mainly of lead glass and may be formed by coating it with glass containing 10 to 25 percent or so of tin oxides and antimony oxides, then sintering at 500 to 585° C. The thickness can, for example, be made 0.01 to 0.05 mm, but the thickness is preferably selected in consideration of the power consumption and stability of the surface potential. Note that when selecting high resistance conductive materials mention may be made of iron oxide, manganese oxide, etc. in addition to the above tin oxides and antimony oxides. These are not particularly limited.

Figure 1:
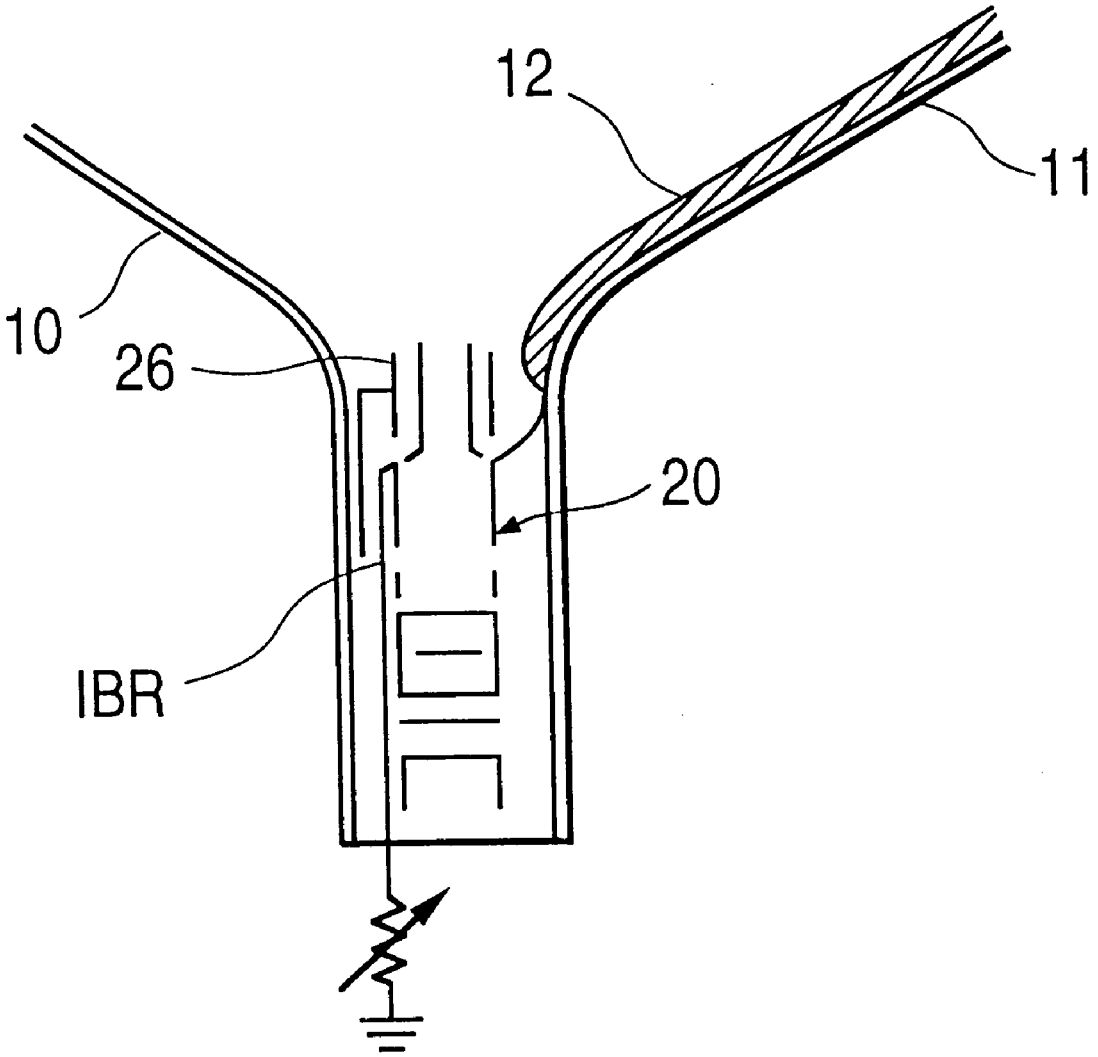
FIG. 1 (PRIOR ART)
FIG. 1 is a schematic view of the layout of IBR in a cathode ray tube.
Figure 2A:
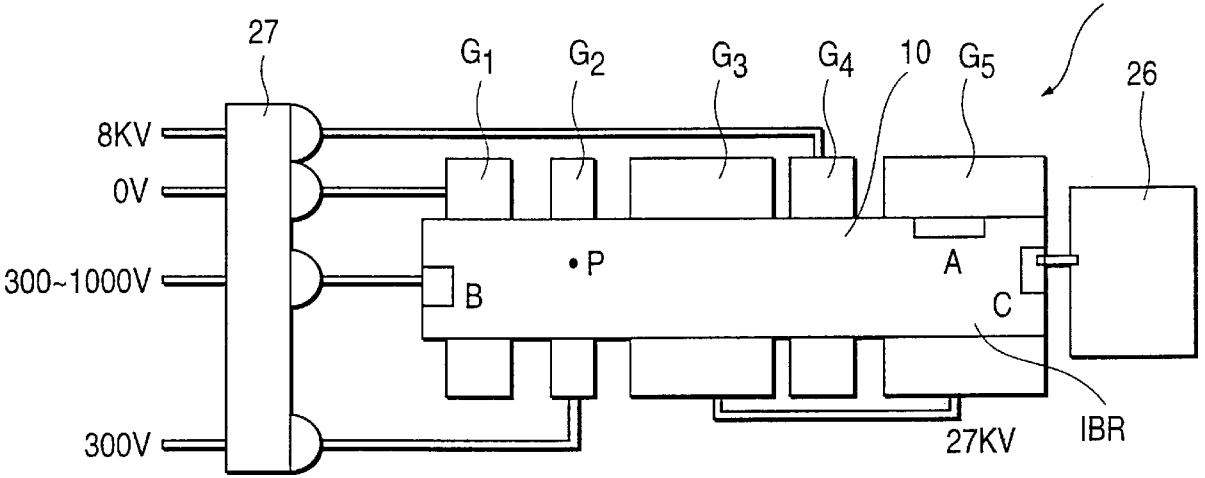
FIG. 2A (PRIOR ART)
FIGS. 2A and 2B are schematic views of the layout of the IBR and electron gun.
Figure 2B:
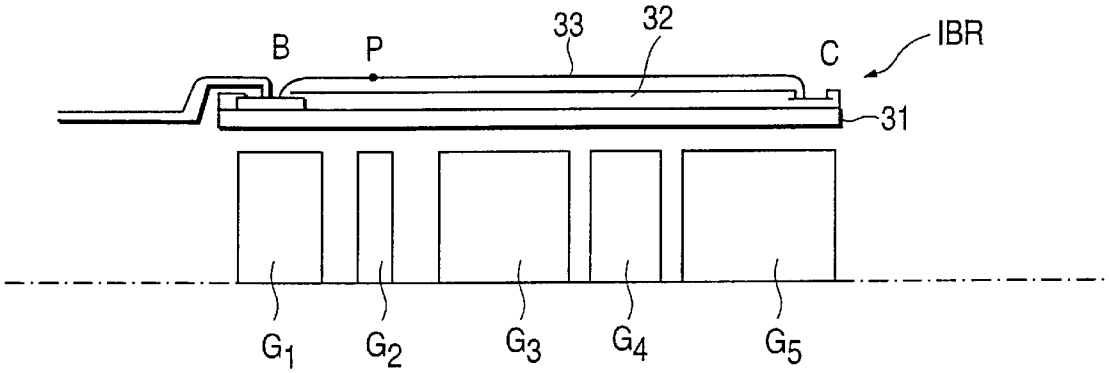
FIG. 2B (PRIOR ART)

This resistance element 1, as shown in FIG. 1 and FIGS. 2A and 2B, may be mounted near the side of the electron gun of the cathode ray tube and used as an IBR for dividing the anode voltage and supplying a deflection voltage or electrode voltage. In this case, the electrode A is supplied with about 27 kV, the electrode B by a voltage several kV lower than this, and the electrode C by a voltage of about 300 to 1000V. Therefore, a high voltage is applied to the high resistance conductive material layer 3.

Figure 13:
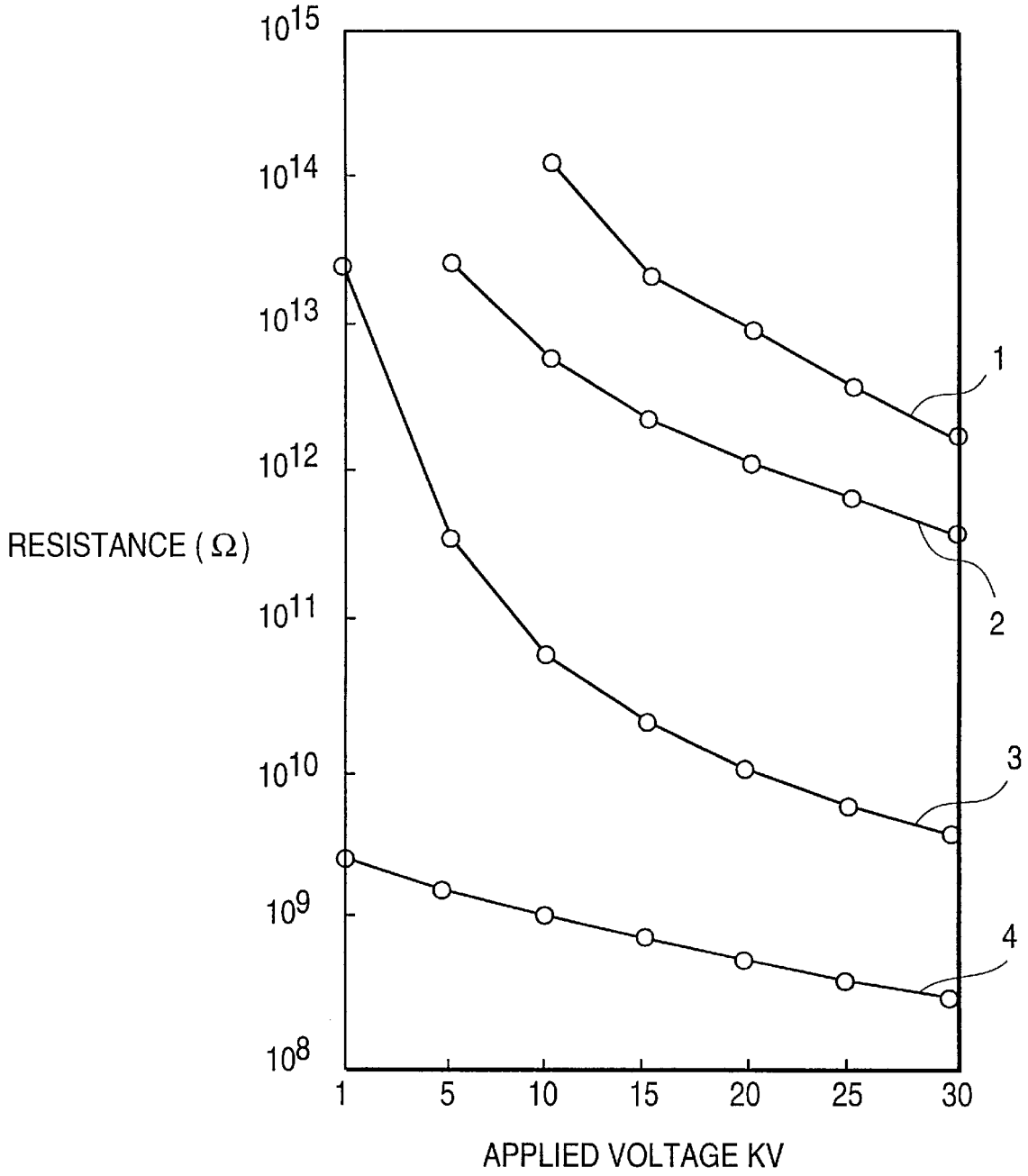
FIG. 13 is a graph of the relationship between the applied voltage and resistance of the high resistance conductive material.
Figure 14:
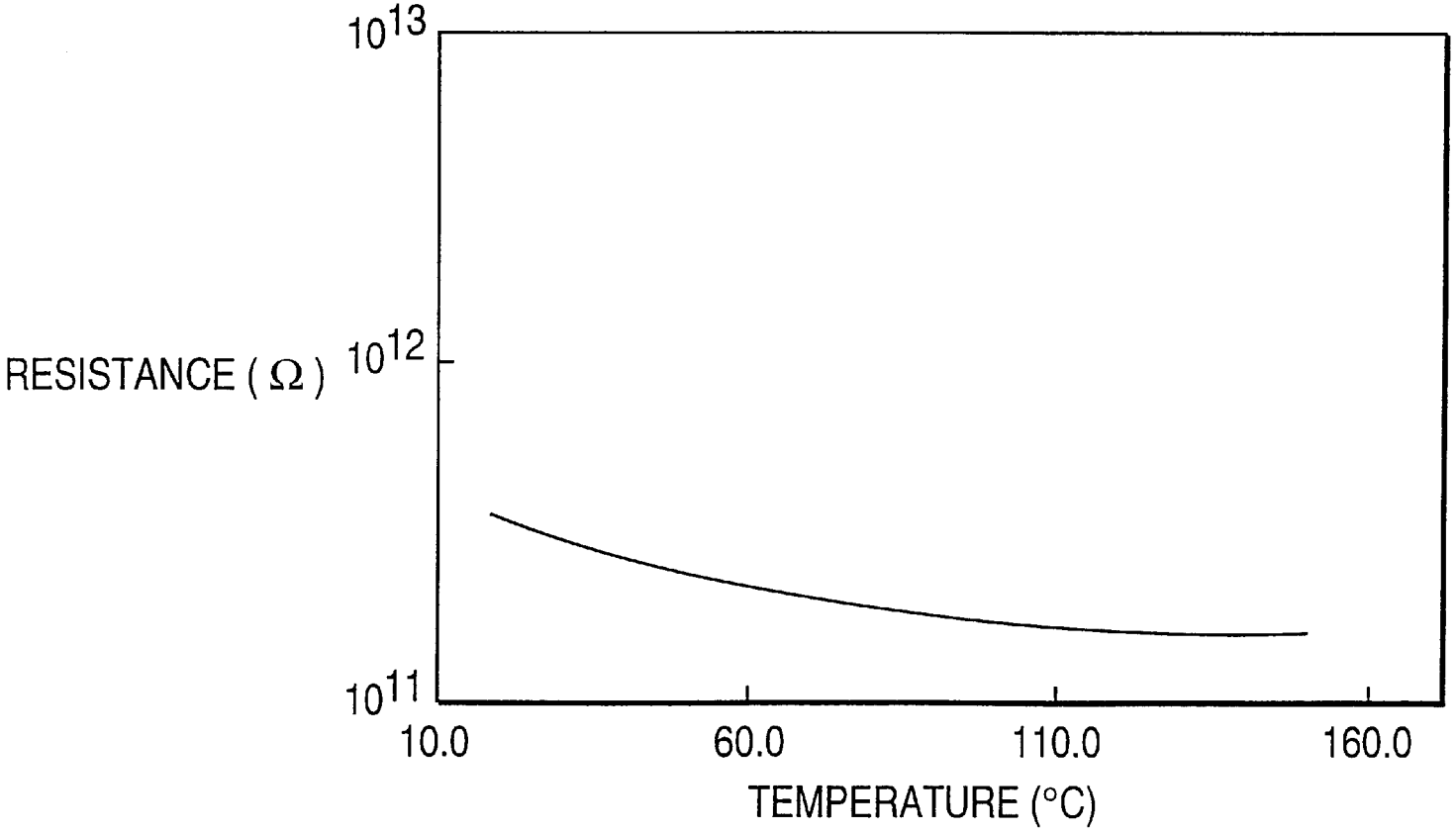
FIG. 14 is a graph of the temperature characteristic of the resistance of the high resistance conductive material.

FIG. 13 is a graph of the relationship between the voltage applied to the high resistance conductive material and the resistance obtained by plotting the measured values using the amount of the tin oxide and antimony oxide in the material as a parameter. The line (1) shows a plot for lead glass with a 15 percent content of tin oxides and antimony oxides sintered at 520° C., line (2) shows a plot for lead glass with a 15 percent content of tin oxides and antimony oxides sintered at 580° C., line (3) shows a plot for lead glass with a 20 percent content of tin oxides and antimony oxides sintered at 580° C., and line (4) shows a plot for lead glass with a 25 percent content of tin oxides and antimony oxides in total sintered at 580° C. It was confirmed that when the amount of the tin oxides and antimony oxides become too great, the resistance value becomes lower. Among these, in the line (2), the resistance was about $10^{11}\Omega$ or so at an anode voltage of 27 kV or the most preferabel voltage. The temperature characteristic of this high resistance conductive ceramic are, as shown in FIG. 14 for example, stable with little change in the resistance even if the temperature rises.

The current flowing in the high resistance conductive material layer (resistivity of $10^{11}$ Ω·cm or so) when a voltage of 30 kV is supplied to the resistance element shown in FIG. 7 at 80° C. was measured, whereupon it was found that there was almost no change in the current value over time and that a very small leakage current flowed stably in the range of 150 to 200 nA. From this, the power consumption is 4.5 to $6\times10^{-2}$ W, which is extremely low compared with the 1 W power consumption of conventional IBRs (resistance value of about $10^{9}$ Ω·cm or so) and therefore no practical problem.

Figure 6:
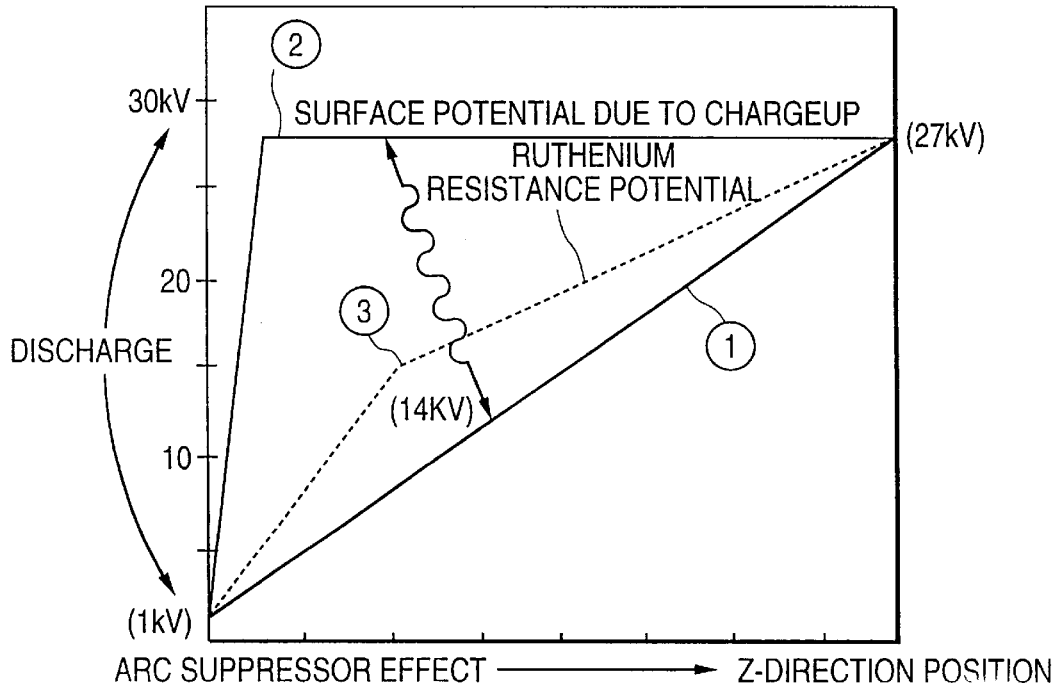
FIG. 6 (PRIOR ART)
FIG. 6 is a graph for explaining the potential of the cathode ray tube in the X-axial direction.

In this way, since there is a high resistance conductive material layer at the topmost surface and since a very small leakage current flows through this high resistance conductive material layer, the resistance element of the present invention will not charge up at its surface. The gradient of potential of the high resistance conductive material layer becomes a straight line proportional to the leakage route as shown by (1) in FIG. 6. For example, the potential of the point P of the high resistance conductive material layer 33 on the second grid $G_2$ (voltage of about 300V) in FIG. 2A stabilizes at 3 kV or so. In the conventional IBR, as shown in FIG. 6, the potential repeatedly changed from 27 kV to about 3 kV due to a repeated charge up and discharge. Due to the stabilization of the surface potential, the potential difference with the electrode B becomes lower and discharge with the electrode B does not easily occur. Further, since the potential differences with the first grid $G_1$, the second grid $G_2$, and the fourth grid $G_4$ also become small, discharge to these grids also does not occur easily. In particular, since the potential difference with the resistors 32 becomes extremely small, discharge to the resistors 32 no longer easily occurs. Further, discharge to other lead wires does not easily occur either.

Therefore, the insulating film and resistors are not easily damaged any more and the resistance value remains stable over a long period, so the convergence potential remains stable and color deviation does not easily occur over a long period.

Explaining the process of production of the resistance element shown in FIG. 7, first the substrate 2 is printed with electrodes A, B, and C using a low resistance paste from for example, the ruthenium oxide family, then the resistors 32 are printed using a high resistance paste from the ruthenium oxide family. Next, this is sintered at, for example, 850° C. Next, the resistance is measured and the resistors 32 are trimmed to bring the resistance to the predetermined value. Next, an insulating film 33 is formed by coating the resistor 32 with for example, a B2O3-SiO2-PbO family glass frit by via silk screen printing etc. and then sintering at, for example, 600° C. The insulating film is then coated with lead glass paste containing about 15 percent tin oxides and antimony oxides via silk screen printing etc., then this is sintered at, for example, 580° C. to form the high resistance conductive material layer 3. After the resistance element 1 is completed, it is inspected visually for bubbles or pinholes etc. in the insulating film 33. In the inspection of the insulating film 33, the resistance element 1 of the present invention does not suffer from ready discharge to resistors 32 due to bubbles or pinholes of the insulating film 33, so the inspection of the appearance can be simplified and costs can be reduced.

Figure 8A:
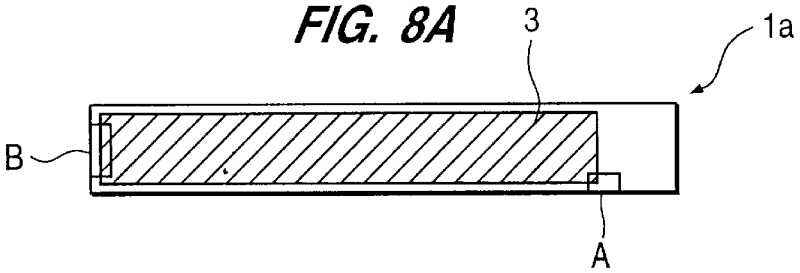
Figure 8B:
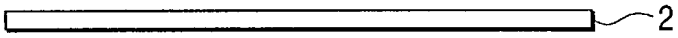
Figure 8C:
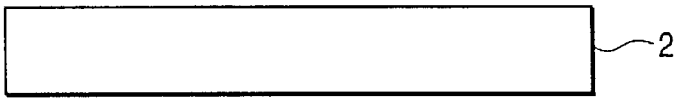
Figure 9A:
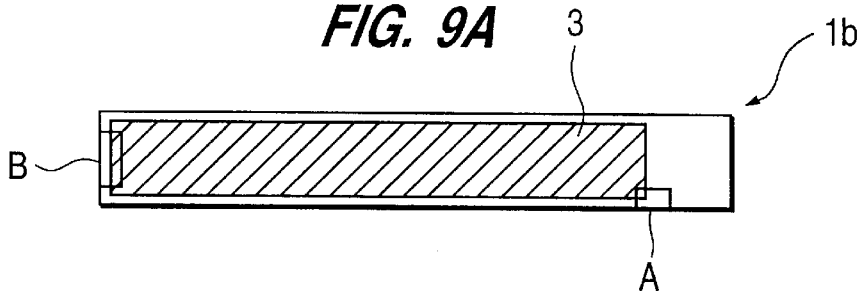
Figure 9B:
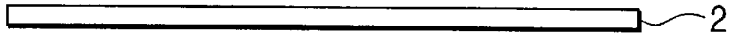
Figure 9C:
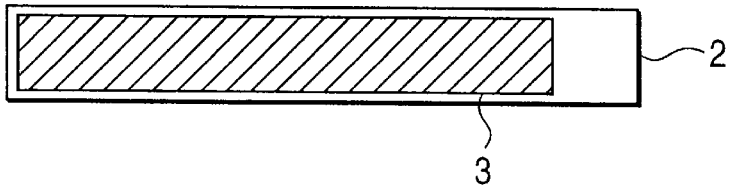
Figure 10A:
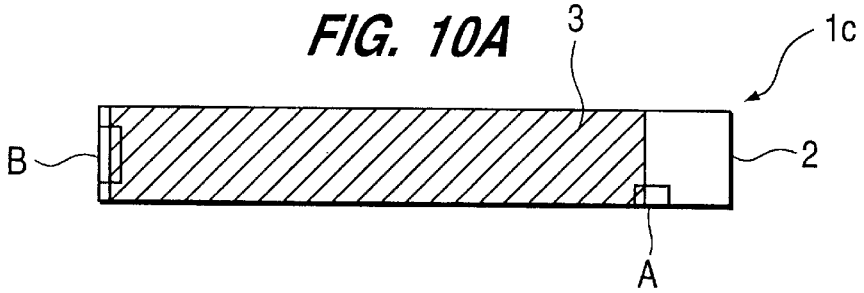
Figure 10B:
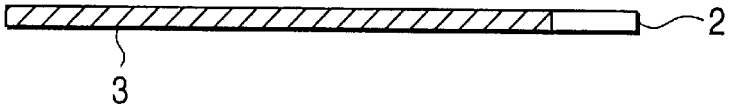
Figure 10C:
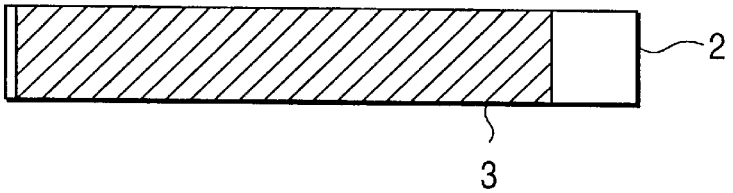

The mode of formation of the high resistance conductive ceramic layer is shown in FIGS. 8A to 8C to FIGS. 10A to 10C. FIGS. 8A, 9A, and 10A are plan views of the surface on which the resistors 32 are formed, FIGS. 8B, 9B, and 10B are side views, and FIGS. 8C, 9C, and 10C are plan views of the reverse side to the surface on which the resistors 32 are formed. FIGS. 8A to 8C show an example of formation of the high resistance conductive material layer 3 on just the surface of the substrate on which the resistors 32 are formed. FIGS. 9A to 9C show an example of formation on the two surfaces, while FIGS. 10A to 10C show an example of formation on the two surfaces and the sides. The best of these performance wise is the example shown in FIGS. 10A to 10C, where the entire surface of the substrate 2 is substantially covered. It is possible to prevent charging over substantially the entire surface of the substrate 22, but this example is disadvantageous from the viewpoint of cost.

Figure 11A:
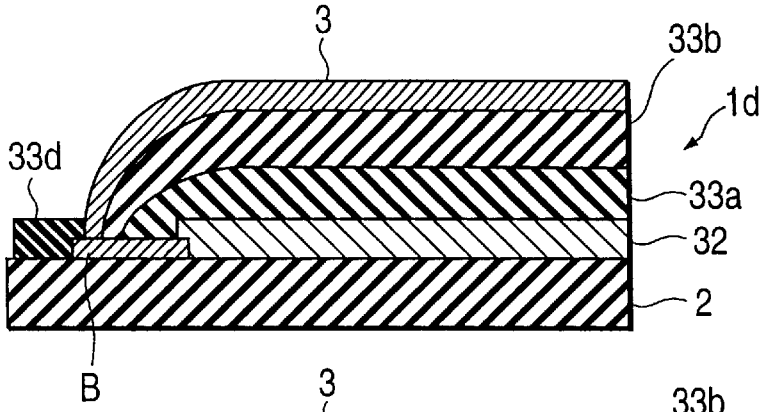
FIGS. 11A to 11E are enlarged sectional views of the area near the electrode B showing the modes for basically forming the high resistance conductive material layer.

Next, an explanation will be given of the modes of coating the high resistance conductive material layer. FIGS. 11A to 11E are enlarged views of the area near the electrode B. The resistance element 1*d* of FIG. 11A is an example of the conventional two layers of overcoat films 33*a* and 33*b*, over which is superimposed the high resistance conductive material layer 3. That is, the electrode A and resistors 32 are formed on the substrate 2 and the insulating film 33*d* is formed between the end of the substrate 2 and the electrode B. A first insulating film 33*a* is formed over substantially the entire surface of the substrate 2 on which the resistors 32 are formed except for the electrodes. A second insulating film 33*b* is superimposed over the first insulating film 33. The high resistance conductive material layer 3 is provided with an end connected with the electrode B on the second insulating film 33*b*.

Figure 11B:
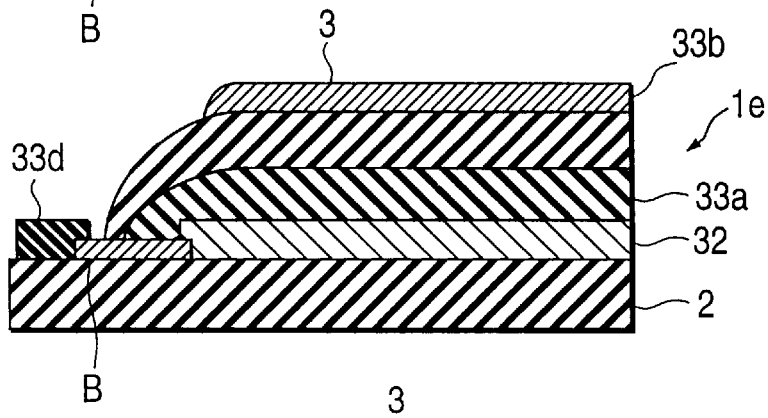

The resistance element 1*e* of FIG. 11B is substantially the same in configuration with that of FIG. 11A but differs in that the end of the high resistance conductive material layer 3 is separated from the electrode B and that the electrode B and the high resistance conductive material layer 3 are not electrically connected. Even if the electrode and the high resistance conductive material layer 3 are not electrically connected in this way, there is no practical problem. The high resistance conductive material layer 3 is usually formed by silk screen printing. In the silk screen printing method, it is difficult to coat depressed areas, so there is an advantage in manufacture if using this configuration.

Figure 11C:
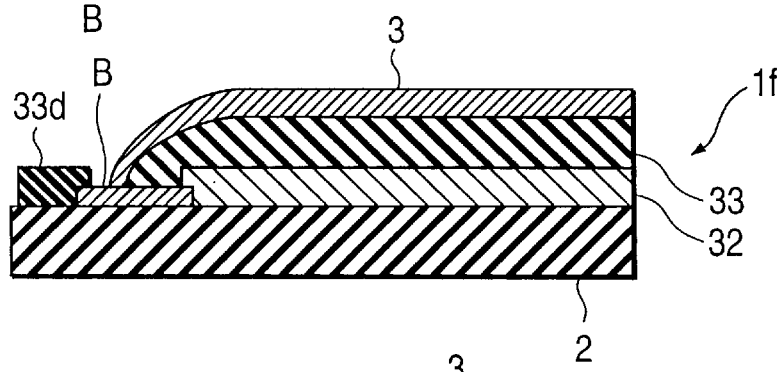
Figure 11D:
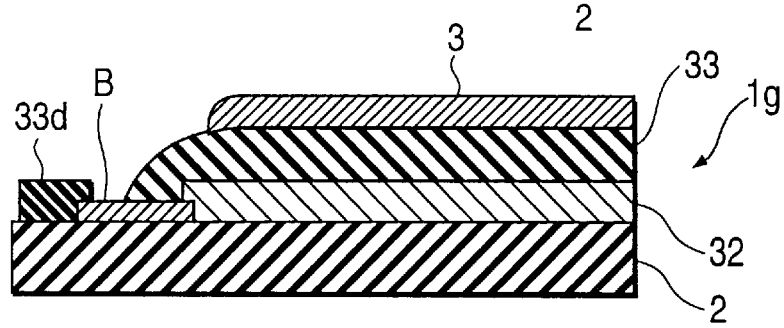
Figure 11E:
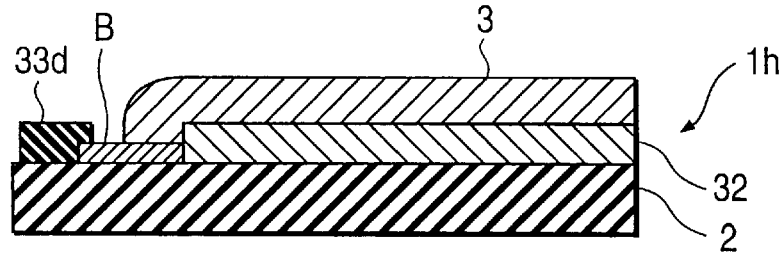
Figure 12:
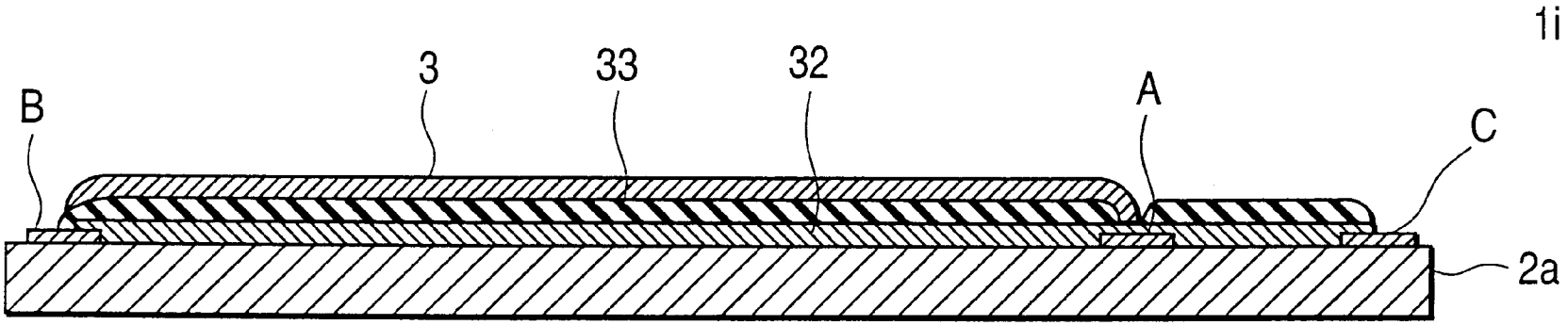
FIG. 12 is a sectional view of another mode of the resistance element of the present invention.

The resistance element 1*f* of FIG. 11C has a single layer insulating film 33 on which the high resistance conductive material layer 3 is superimposed electrically connected with the electrode B. The potential of the high resistance conductive material layer 3 near the electrode B is at a stable low level, so the insulation resistance of the insulating film 33 need only be a small one; therefore there is no longer a need to make the insulating film 33 thick. Accordingly, as shown in FIG. 11C, it is possible to simplify the insulating film 33 from the conventional two layers to one. In this case, the thickness of the insulating film 33 may be made, for example, about 0.2 to 0.3 mm or so. Even if the insulating film 33 is made a single layer, as shown in FIG. 11D, it is also possible to have the high resistance conductive material layer 3 and the electrode B electrically isolated. Further, when the high resistance conductive material layer 3 will not damage or react with the resistors 32, as shown in FIG. 11E, it is possible to omit the insulating film 33 and cover the resistors 32 with just the high resistance conductive material layer 3 and further reduce costs. Further, as shown in FIG. 12, it is possible to make the substrate 2*a,* for example, 85 percent alumina and the remaining 15 percent niobium, iron, manganese, etc. to make it a high resistance conductive ceramic having a resistivity of $10^6$ to $10^{14}$ Ω·m at 150° C. If the substrate 2*a* is comprised of such a high resistance conductive ceramic, then a very small leakage current will flow in the substrate 2*a,* the substrate 2*a* will no longer charge up, and the potential of the resistance element 1*i* will become even more stable. Further, it will become possible to omit the formation of the high resistance conductive ceramic film at the surface opposite the surface where the resistors 32 are formed and therefore the costs can be reduced further.

After completing the resistance element, it is assembled into an electron gun, the chamber to evacuated and sealed, and treatment called "conditioning" or "arcing" is performed by supplying a voltage higher than the voltage rating of the resistance elements. Any change in the value of the resistance of the resistors before and after this treatment indicates that the resistors have been damaged from the treatment.

When a high voltage is supplied to the resistance elements shown in the above FIGS. 8A to 8C to FIGS. 10A to 10C by this treatment, the surfaces where the high resistance conductive material layers were formed did not fluoresce, while the portions where the layers were not formed fluoresced pink. In each case, there was almost no change in the resistance values of the resistors and there were no problems at all. From these results, it was confirmed that the formation of a high resistance conductive material layer causes the surface potential of the resistance element to stabilize.

In FIG. 7 and the other drawings, the substrates were all shown as being flat plates, but they may also be cylindrical, tubular, or any other shape. Other various modifications not out of the scope of the invention may be made as well.

The resistance element of the present invention can divide the high voltage of the cathode ray tube and supply voltage stably with less discharge.

Further, the cathode ray tube of the present invention can operate stably over a long period since it uses this resistance element for the division of voltage of the electron gun.

What is claimed is:

1. A resistance element which is formed on a substratre by resistors and which divides and supplies high voltage in an electron gun of a cathode ray tube, comprising:

a substrate;

at least one resistor disposed on said substrate;

at least one electrode disposed on said substrate and associated with said at least one resistor; and a high resistance conductive material layer disposed over said at least one resistor as a topmost layer on said substrate.

2. The resistance element of claim 1, wherein said high resistance conductive material layer acts as a semi-insulating film covering said at least one resistor on the substrate.

3. The resistance element of claim 1, wherein the resistivity of material used in said high resistance conductive material layer is $10^6$ to $10^{14}$ Ωm at 150° C.

4. The resistance element of claim 1, wherein the resistance element has at least two resistors, and wherein said high resistance conductive material layer is formed to connect the electrodes associated with said at least two resistors.

5. The resistance element of claim 1, wherein said substrate is formed of a high resistance conductive ceramic.

6. A cathode ray tube, comprising:

an electron gun; and a resistance element coupled with said electron gun, the resistance element including a substrate;

a plurality of resistors disposed on said substrate a high resistance conductive material layer disposed over said plurality of resistors as a topmost layer on said substrate, wherein said resistance element divides and supplies high voltage to said electron gun.

7. The cathode ray tube of claim 6, wherein said high resistance conductive material layer in said resistance element acts as an semi-insulating film covering said plurality of resistors on said substrate.

8. The cathode ray tube of claim 6, wherein the resistivity of material used in said high resistance conductive material layer in said resistance element is $10^6$ to $10^{14}$ Ωm at 150° C.

9. The cathode ray tube of claim 6, wherein said resistance element has a plurality of electrodes associated with said plurality of resistors, and wherein the high resistance conductive material layer connects at least two of said plurality of electrodes associated with said plurality of resistors.

10. The resistance element of claim 1, wherein said substrate is formed of a high resistance conductive ceramic.

* * * * *